US005364047A

United States Patent [19]

Petit et al.

[11] Patent Number: 5,364,047

[45] Date of Patent: Nov. 15, 1994

[54] AUTOMATIC VEHICLE CONTROL AND LOCATION SYSTEM

[75] Inventors: William A. Petit, Spencerport; George G. Maderer, Rochester; Samuel J. Macano, Macedon; James R. Hoelscher, Rochester, all of N.Y.

[73] Assignee: General Railway Signal Corporation, Rochester, N.Y.

[21] Appl. No.: 41,953

[22] Filed: Apr. 2, 1993

[51] Int. Cl.[5] ..... B61L 27/00

[52] U.S. Cl. ..... 246/122 R; 246/182 R

[58] Field of Search ..... 246/27, 3, 4, 6, 14, 246/20, 27, 28 R, 31, 62, 107, 122 R, 124, 182 R, 182 B

[56] References Cited

U.S. PATENT DOCUMENTS

| | | | |
|---|---|---|---|
| 4,166,599 | 9/1979 | Auer et al. | 246/63 A |
| 4,266,273 | 5/1981 | Dobler et al. | 246/6 |
| 4,495,578 | 1/1985 | Sibley et al. | 246/62 |
| 4,611,291 | 9/1986 | Hoelscher | 246/3 |
| 4,617,627 | 10/1986 | Yasunobu et al. | 246/182 R |
| 4,735,383 | 4/1988 | Corrie | 246/122 R |
| 4,863,123 | 9/1989 | Bernard et al. | 246/122 R |

FOREIGN PATENT DOCUMENTS

| | | | |
|---|---|---|---|
| 2943385 | 5/1981 | Germany | 246/14 |

*Primary Examiner*—Mark T. Le
*Attorney, Agent, or Firm*—John F. Ohlandt

[57] ABSTRACT

A signaling and traffic control system which is capable of a vehicle determining its own absolute position along a guideway based on information received from the wayside using an inductive loop or beacon system in conjunction with the distance traveled according to the onboard tach generator(s), and report its position to a wayside control device, whereby the wayside control device reports to the vehicle, as part of its communications message, the location of the closest forward obstacle. Based upon this information, the vehicle controls itself safely based upon its characteristics as contained in a topographicla database and a vehicle database.

15 Claims, 4 Drawing Sheets

AUTOMATIC VEHICLE CONTROL AND LOCATION SYSTEM

The present invention relates to signaling and traffic control systems, and particularly to a railway signaling and traffic control system wherein a unique vehicle-based topographical database combines with a wayside-based signaling means to provide vital control of each respective vehicle traveling along the guideway.

BACKGROUND OF THE INVENTION

Various systems have been designed to allow automatic (driverless) operation of rapid transit vehicles in mainline revenue service (i.e., passenger carrying operations) using either fixed block or moving block designs.

In a fixed block design the guideway is divided into segments called blocks. Such a design can be appreciated from U.S. Pat. No. 4,166,599 (Auer, Jr. et al.), which issued on Sep. 4, 1979, and which is incorporated herein by reference.

In the system briefly described in U.S. Pat. No. 4,166,599, block boundaries are identified by short vertical strokes through the horizontal line identifying the guideway. An apparatus is arranged in each block, for detecting the presence of a vehicle in that block. This wayside apparatus may be coupled to wayside apparatus of one or more adjacent upstream blocks for the purpose of informing vehicles in such upstream blocks of the presence of a vehicle in a downstream block. In one specific application, for example, the block directly upstream of an occupied block is provided with the signal requiring an emergency stop. The next adjacent upstream block is provided with a signal requiring a stop, the next adjacent upstream block is provided with a signal calling for a low speed, and so on. In effect, an information communication arrangement is combined with distributed wayside data processing or computing. In such a system, the vehicle headway, i.e., the distance between moving vehicles, is at least one block long, and may, in normal practice, be two or more blocks long. Fixed blocks have the disadvantage of not providing maximum performance and cannot be easily overlaid on existing track circuits. They do, however, have the advantage of a distributed architecture.

In the moving block design each vehicle that is being controlled, transmits its location to a controlling authority, usually on a periodic basis. Thus, the controlling authority has available to it information as to the location and, perhaps speed, of all the vehicles being controlled. Under these circumstances, the controlling authority then provides signals to the vehicles, based upon downstream traffic conditions, allowing the vehicles to proceed at safe speeds, or on the other hand, requiting the vehicles to stop. See U.S. Pat. No. 4,711,418 (Auer, Jr. et al.), which issued on Dec. 8, 1987 and which is incorporated herein by reference. Moving block systems improve performance but are highly centralized leaving availability and start-up problems.

A third method for automatic (driverless) operation is also set forth in U.S. Pat. No. 4,166,599. This patent discloses a control system in which each vehicle has provided to it information regarding the next adjacent downstream occupied or unavailable block; the system relies on distributed (i.e., vehicle carried) data processing or computing. This system avoids the need for multiple communication channels required by the conventional moving block approach. At the same time, however, the single communication channel may provide to any vehicle the identity of the block it occupies, the identity of the next adjacent downstream occupied or unavailable block, and the speed of the vehicle in such block.

With this information, the upstream vehicle's headway can be reduced to approach the headway achievable in moving block systems.

The primary objectives of designing a new railway signaling and traffic control system are to achieve a system which is flexible and capable of optimal passenger throughput. Optimal passenger throughput can be obtained by minimizing vehicle headway and maximizing passenger management. These systems must be compatible with driverless operation and with automatic operation which employs various levels of driver intervention.

It is also a goal that such systems be applicable as an overlay to existing systems to provide various levels of upgraded operation. To achieve this goal, a system must be capable of being applied in a modular fashion to meet the current needs of a particular system operator while being capable of expansion to a higher degree of automatic operation.

Any new system design should also minimize the required wayside hardware, installation and testing time and maximize the system reliability and availability. In addition to redundancy (hot standby) capabilities, high system availability can be achieved by designing a system which has clear fall back operating modes in the presence of failures.

The major obstacles to implementing complete vehicle carried systems are vital methods of having vehicles determine the position of vehicles in front of them and of vehicles vitally controlling switches and routes without vital wayside help. The present invention which uses carborne intelligence in the form of a topographical map database transfers a substantial amount of vehicle control and position of location determination responsibility to the vehicle-based equipment, thereby reducing the information which is required from the wayside-based equipment.

In general, the present invention provides a railway signaling and traffic control system design which centers around the use of communicating vital information between the wayside and the vehicles and the use of an onboard topographic database. With each vehicle containing a vital database which represents the system topology, the system is designed to be very flexible with a minimum of wayside hardware. One major advantage to of this scheme is to concentrate the majority of the equipment with the vehicle, which allows equipment preventive maintenance to be accomplished at a central location. Therefore, the present invention provides the performance advantages of a moving block system, while maintaining a distributed architecture to provide reliable and available service such as that provided in fixed block systems.

The present invention also provides many additional advantages which shall become apparent as described below.

SUMMARY OF THE INVENTION

A signaling and traffic control system which comprises: a vehicle-based control means capable of determining the location of a vehicle as it traverses along a guideway, said vehicle-based control means having an onboard computer means with a topographical database and a vehicle database, and means for measuring the speed of said vehicle and the distance which said vehicle has traveled; wayside control means disposed within each sector of said guideway, said wayside control means being capable of communicating with all vehicles within its sector of control and with other wayside control means outside its sector of control; means for communicating from said vehicle to said wayside control means and from said wayside control means to said vehicle; a plurality of vehicle location information means disposed along said wayside, so that said vehicle can determine its absolute location along said wayside; means for communicating from each vehicle location information means to said vehicle, including means on said vehicle for responding to signals received from said vehicle location information means so as to determine said absolute location of said vehicle; and means for controlling the speed/stopping profile of said vehicle of said vehicle in accordance with inputs received from said onboard computer means, said inputs being generated based on information received from said topographical database and said vehicle database, and based on information communicated to said vehicle-based control means from said wayside control means, from said vehicle location information means, and from said means for measuring the speed of said vehicle and the distance which said vehicle has traveled.

DESCRIPTION OF THE PREFERRED EMBODIMENTS

A railway signaling and traffic control system capable of determining a vehicle's absolute position or location (based on information received from the fixed wayside reference using an inductive loop or beacon system in conjunction with the distance traveled according to the onboard tach generator(s), report its position to the wayside control means and the wayside control means will report to the vehicles, as part of its communications message, the location of the closest forward obstacle. This obstacle may be an unlocked switch, another vehicle, etc.

The vehicle onboard intelligence, using a system or topographical database in the form of tables, allows the vehicle to determine the distance between itself and the nearest obstacle. With this information the vehicle will generate a safe speed limit profile including any civil speed restrictions and/or station stopping points to bring the vehicle to a safe stop short of the obstacle or in the station.

This intelligent railway signaling and traffic control system requires the following major subsystems: a vital communications system between the vehicle and wayside, a vital carborne profile generation/automatic train protection (ATP) system, a vital carborne topographical intelligence, wayside beacons or other location system, a vital wayside means of determining next forward obstacle for each vehicle. In addition, an optional non-vital information system can be incorporated into the system.

Figure 2:
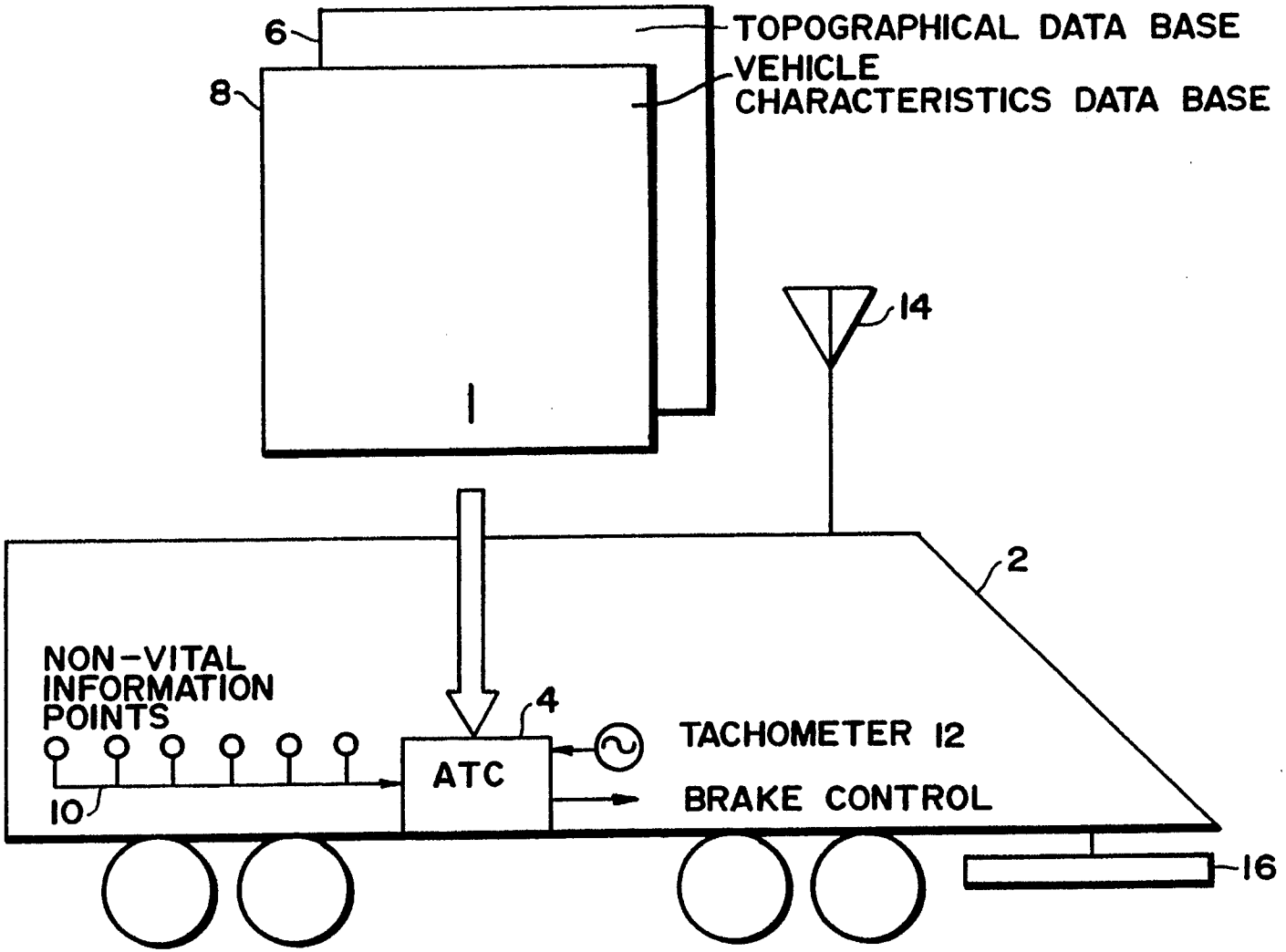
FIG. 2 is a schematic representation of a vehicle-based location control system in accordance with the present invention.

The onboard system topographical data base, as illustrated in FIG. 2, can be used to generate civil speed restrictions (including those necessary for reverse switch moves) and station stopping points. A typical vehicle 2 will include an automatic train controller 4, i.e., a microprocessor, which has been pre-programmed with a topographical database 6 comprising a table of fixed map parameters 8. The fixed map parameters 8 may include the grade of the track, the switches along the track, the civil speed limits about the track:, location of wayside beacons, loops and station locations. Using the topographical data base, and actual speed of the vehicle as determined by one or more onboard tachometers 12, the automatic train computer allows precision station stopping, speed profiling and door control at each station. Each vehicle 2 also includes an RF antenna 14 an loop antenna 16 to transmit and receive communications to and from wayside-based equipment. Each vehicle also includes a beacon antenna or loop antenna transition detector for transmitting absolute vehicle position.

The onboard ATP equipment utilizes the topographical data in conjunction with the wayside transmitted information regarding switch positions and the location of other vehicles or obstacles in its directional path to generate a speed/stopping profile. This profile will bring the vehicle to a stop before it reaches the closest obstacle or at the correct position in a station platform taking into account the vehicle minimum design level braking characteristics and the grade of the directional path. The system also allows for central control to modify train schedules.

The functions of the wayside-based equipment (i.e., wayside control means and vehicle location information means) are to control switches, obtain and transmit the locations of vehicles in the control segment, hand the vehicles off between control segments, and interface with the central control office. The vehicle location information means (beacons or loop transitions, for example) provides an absolute location reference system that the vehicles can use to update their positions. The vehicles will keep track of their position between these absolute references using one or more onboard tachometer(s) and/or the control section IDs provided by the wayside communications.

Communications from the wayside-base equipment to the vehicle may include: sector or antenna ID, vehicle ID, obstacle location, switch position and ID or route, proceed permission, travel direction, open doors, hold with doors open, change vehicle orientation/direction, and non-vital management and control information.

Communications from the vehicle to the wayside control means may include: vehicle ID, control unit location, train length, train location, travel direction, train speed, train status, non-vital management and control information, and route cancel request accepted.

Communications from one wayside control means to another wayside control means may include: sector ID, position and status of switches or routes, routes that are free, status of turnback operations, list of trains which have checked in but were not handed off ID of train being handed off route canceled and non-vital management and control information.

Communications from wayside control means to a central control office may include: train positions and IDs, traffic direction, route status, status of vehicle and wayside systems, station conditions, schedule modifications/time adjustments, and non-vital management information.

There are two preferred types of data links which make up the vehicle to wayside communication means which provides the vehicle with absolute vehicle location information on a routine basis. The first type is an inductive loop system. The most general wayside location for an inductive loop antenna system is mounted between the rails or on the running surface of the guideway. Other locations (such as third rail cover, tunnel wall or ceiling, etc) are possible but depend on the configuration of the vehicle and guideway. The frequency range of the loop signal is typically in the 1 Khz to 300 Khz range. The inductive loop functions as a large single turn transformer winding (antenna) on the vehicle.

The vehicle antenna for a track mounted inductive loop system is mounted to the underside of the vehicle such that the vertical distance from the wayside loop controller is typically less than 25 cm.

The second type of data link uses radio frequency (RF) communications between the vehicle and the wayside. There are two basic forms; communication between a point vehicle antenna and communication between a point vehicle antenna and a linear wayside antenna ( e.g. leaky coax).

There are also two preferred types of vehicle location information means. The first is based on the use of the inductive loops described previously. A unique ID broadcast through the loop provides gross location information while the vehicle obtains the fine location information by counting phase shifts due to loop transitions on the wayside.

The second vehicle location information means is a beacon system. The beacon system is a radio-based communication link which uses radio frequency (RF) communications between the vehicle and the beacon. A typical beacon is a passive transponder, encoded with a unique ID, excited by RF energy from a vehicle based interogator (beacon reader). Onboard tachometers may be used to provide fine location information between the beacons.

A typical installation would use RF communications for the wayside to the vehicle communication means along with beacons for vehicle location information means or it would use inductive loops for both wayside to vehicle communication means and vehicle location information means.

Figure 1:
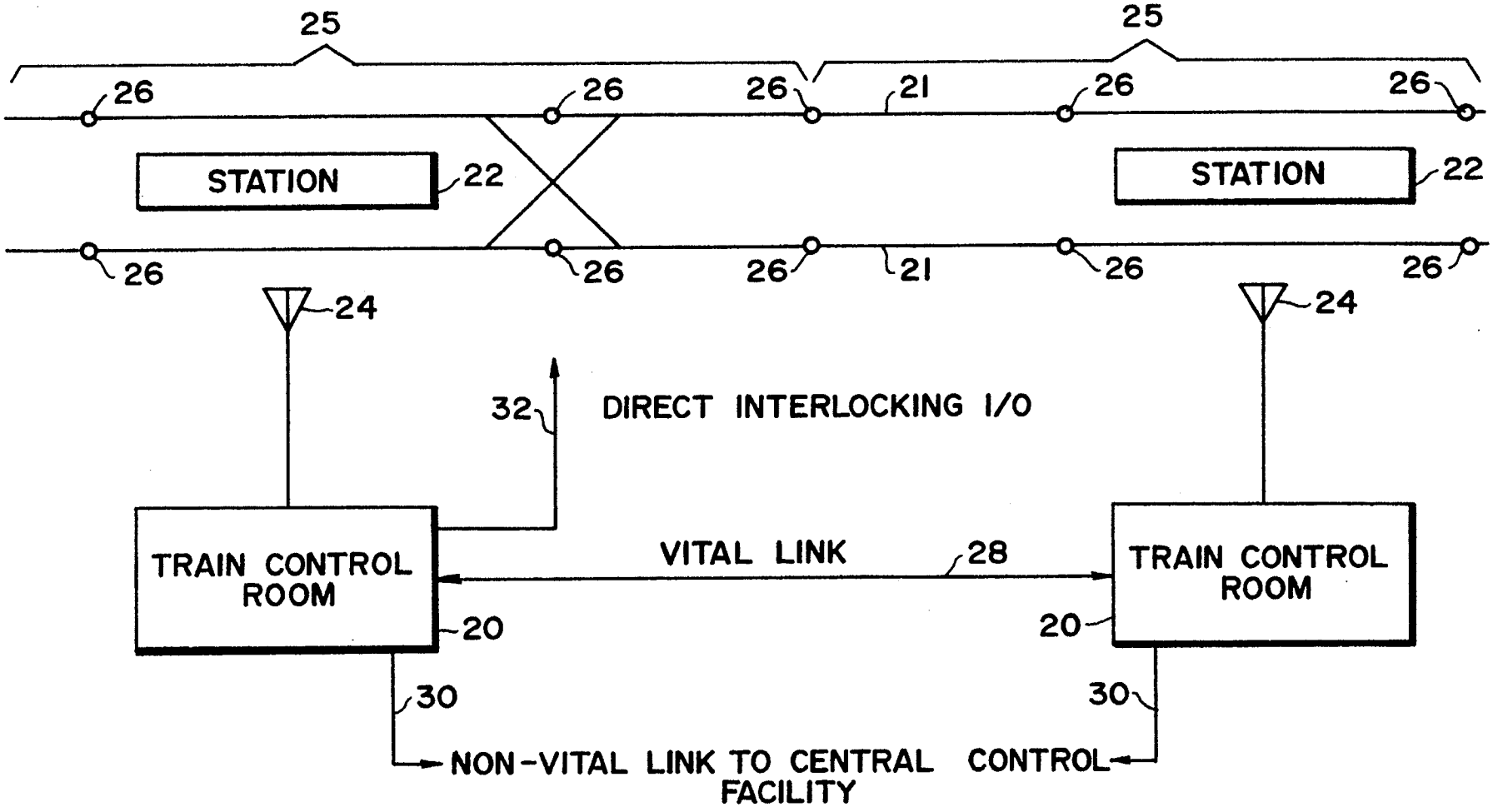
FIG. 1 is a schematic diagram of the wayside control means used in accordance with the present invention.

It should be apparent that a wide variety of communication means and vehicle location information means can be used as alternative to these preferred types. This train control system is a train oriented block system (i.e., moving block). The system requires vital two-way data communication between the wayside and the vehicle, and between adjacent control sectors. As shown in FIG. 1, the wayside is organized into control sectors 25. A sector may include all tracks (both directions) centered on a wayside station location, be divided into a sector per track 21, or include several stations 22 per sector. This is dependent on the design of the communication antenna structure 24, the complexity and number of interlockings, the headway requirements, etc. Train control room 20 controls the communications to vehicles, the alignment of interlockings within the sector (route control), and station interfaces within the sector. Each train control room 20 is in communication with adjacent train control rooms by means of vital communication links 28 (e.g., a twisted pair of fiber optics). Moreover, each train control room 20 is in communication with a central control office, not shown, via non-vital communication link 30 (e.g., a fiber optic).

Figure 3:
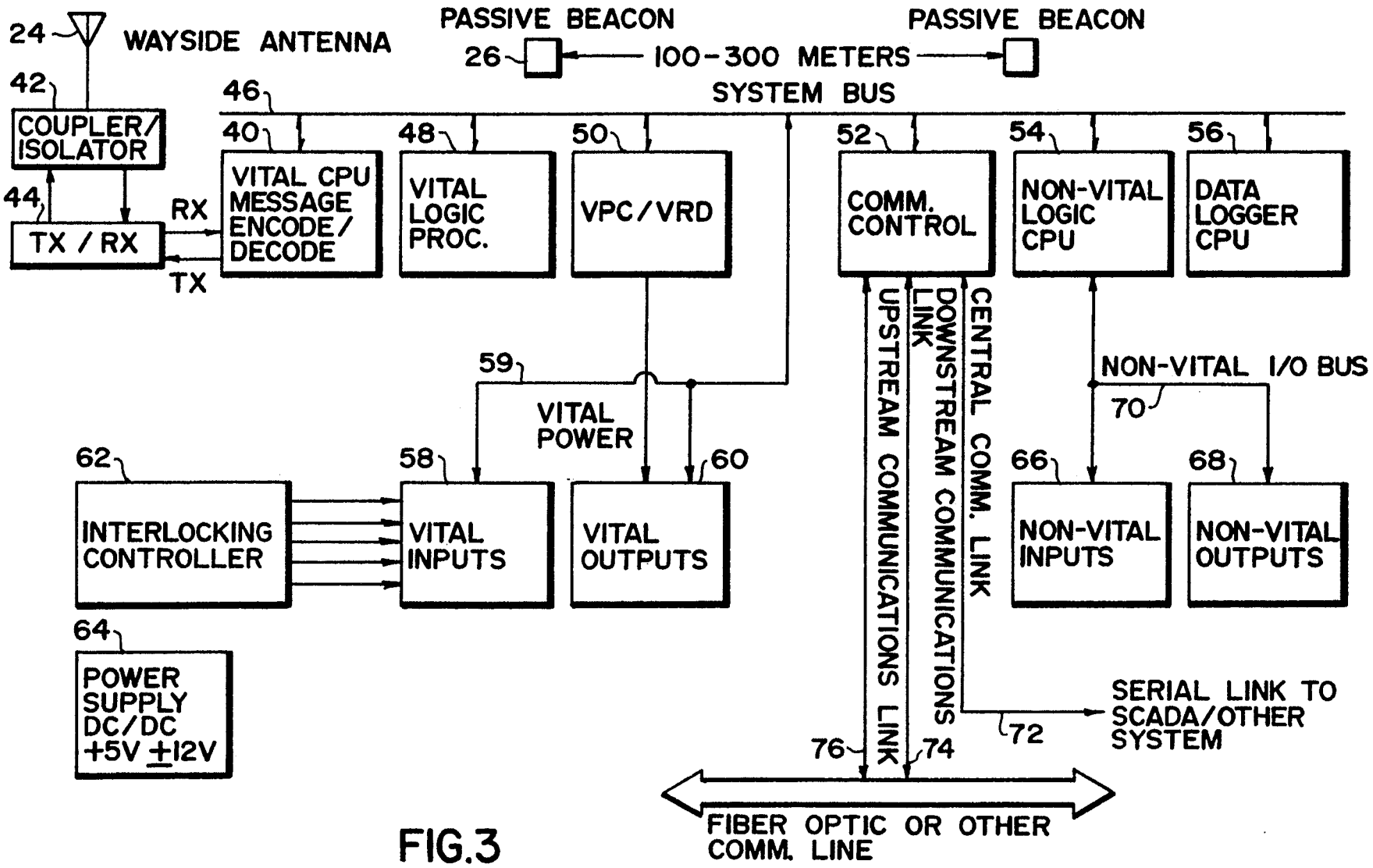
FIG. 3 is schematic representation of a wayside-based signaling and traffic control system in accordance with the present invention.

FIG. 3 is a schematic representation of the preferred wayside control means wherein a wayside antenna 24 is connected to a vital CPU message encoder/decoder 40 via coupler/isolator 42 and transmitter/receiver 44. Thereafter, encoder/decoder 40 is connected via system bus 46 in a bidirectional relationship to a vital logic processor 48, a source of vital energy (VPC/VRD) 50, wayside communications control 52, non-vital logic CPU 54, data logger CPU 56, vital input and vital output. VPC/VRD 50 provides vital output energy to vital outputs 60. In the event of an unsafe failure, vital energy is removed from vital outputs 60 causing them to go to a safe state. Vital input unit 58 receives inputs from interlocking controller unit 62 (e.g., relay interlockings). If an electronic interlocking, such as a VPI® (vital Processor Interlocking), manufactured by General Railway Signal Corporation, is used, the vital data is transferred via a serial communications link into the communication controller 52. The entire wayside control means is preferably powered by a DC/DC power supply 64. Non-vital logic CPU 54 is connected to non-vital inputs 66 and non-vital outputs 68 via non-vital I/O bus 70. This wayside sector controller is connected to other wayside sector controllers and a central office via communication controller 52 and a central communications link 72, downstream communications link 74 and upstream communications link 76.

Figure 4:
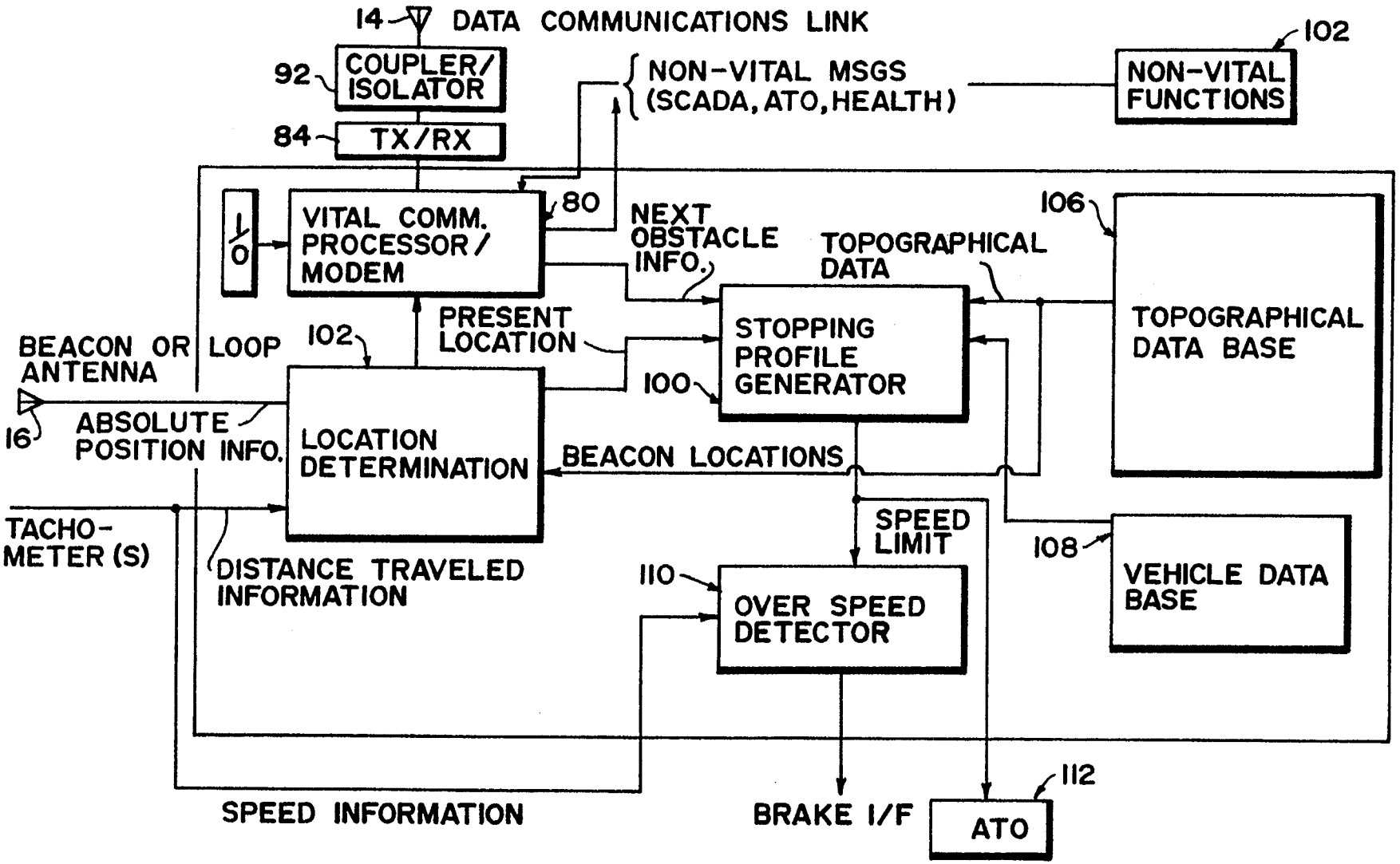
FIG. 4 is a schematic diagram of the vehicle-based control means used in accordance with the present invention.

The vehicle-based control means is shown in FIG. 4 and includes an antenna 14 which is capable of transmitting and receiving signals to and from wayside antenna 24. Antenna 14 is connected to a vital communication processor modem 80 via coupler/isolator 82 and transmitter/receiver unit 84. Vital communication processor 80 provides next obstacle information to the profile generator 100 and non-vital messages (e.g., SCADA, ATO, vehicle health) to non-vital system 102. The location determination function of non-vital system 102 determines absolute location via, for example, beacons and tachometer pulses. Alternative methods of location determination can also be used here. The stopping profile generator 100 uses absolute location information, next obstacle information, topographical information (from topographical database 106), and vehicle parameters (from vehicle database 108) to calculate a stopping profile allowing the vehicle to stop safely. The stopping profile generates speed limits for use by overspeed detector 110 and ATO (automatic train operation) functions 112. Overspeed detection 110 vitally compares speed limit with actual speed and applies brakes if vehicle overspeed is detected. ATO functions 112 automatically drive the train non-vitally if desired. Vital control functions are maintained by the overspeed detection.

Communications to vehicles are typically handled on a polled basis. The wayside control means establishes communication with a train by assigning it a time slot in its poll. The train knows its absolute location. This fact, along with all operational aspects, are checked by communication between vehicle-based control means and wayside control means. Typically, there would be 10 to 16 time slots available in each sector. The number of time slots determines the maximum number of trains that can be handled within a sector. One implementation communicates with each vehicle at least once a second. The system would be organized such that a sector reaching its maximum communication capability (i.e., all time slots filled) would temporarily block entrance to the sector by new vehicles until such time as other trains leave the sector.

When it is time to "launch" the vehicle into service and the path ahead of the vehicle is clear, the wayside enables the "go" message and sends to the vehicle the location of a target point ahead of the vehicle. The vehicle ATP (Automatic Train Protection) then checks forward on its topographical database to the target point. The position of any switches along this path are verified (i.e., this information is sent by the wayside control means along with the target point if there are any switches in the path). The vehicle's onboard computer then starts a mathematical regression from the target point in Ad (distance) increments using safe braking rate and grade to determine braking deceleration. This determines the vehicle speed at the entrance to the $\Delta d$ section. The calculation then works back to the next $\Delta d$ increment and so on until the calculated speed reaches the civil limit for on increment or the regression reaches the current location of the vehicle. This speed is the ATP speed limit. An automatic train operation (ATO) speed less than the calculated ATP speed is then used by the onboard ATO speed control function. If the regression calculation reaches a civil limit, the lower limit of the two (i.e., civil and calculated) is used as the ATP speed limit.

Vehicle length also enters into the calculation since the civil limit applies as long as any part of the vehicle is within the zone of calculation. The resolution of the topographical database determines the $\Delta d$ length. Calculations can be repeated each time the vehicle travels this distance or the calculation can be done only when a communication update occurs or a combination of the two.

As a train travels a sector, its target stopping point is moved ahead by the wayside control means as updated vehicle position information from vehicles ahead is received, unless a vehicle is stopped or an obstruction does not clear. A station platform has a fixed target which is the alignment point for vehicle and station. If the station is to be skipped, the wayside control means sends a non-vital skip stop message to the ATO system.

The system has several features which will allow a vehicle to determine its own position even if it loses position information momentarily. A small discrepancy is allowed as tolerance. This error will correct itself at antenna transition points or beacons. But if transitions are missed or some failure occurs, then a vehicle would no longer know its absolute position within an acceptable tolerance. The following can be used to allow recovery of such a vehicle: (1) each loop antenna sector transmits a unique identity code and the vehicle correlates this with data from the topographical database to determine its sector location; (2) loop transpositions occur in a random pattern within the antenna sector, such that they create a unique signature. The above techniques are for systems using inductive loops for communication. For systems utilizing beacons, the beacons are used for updating absolute position.

A second concern is when a wayside sector controller is momentarily reset causing it to lose data identifying which vehicles are in its sector. This is handled in the following manner. A sector controller retains the order in which vehicles pass through and are handed off to the next sector. They are removed from the local sector controller's memory only when a train is handed off to the sector beyond the next sector. This will allow a wayside control means for a specific sector to recover from an operational malfunction because its neighbors will have the information regarding the number and identity of vehicles which are within the downed sector. When a wayside control means comes back online and establishes communications with all of these vehicles, then an automatic recovery can be initiated.

If the system uses inductive antenna, the onboard vehicle topographical database contains the location and ID of every loop, the loop length and the spacing of each loop's transpositions. If the system uses beacons, the onboard vehicle topographical data base contains the location and ID of every beacon plus the ID of every sector. The vehicle counts pulses from the tach generator (e.g., tachometer) to keep track of its position from the last transposition. The topographical database also contains the location of all switches, stations (platform side and stopping point), speed restriction areas and all other pertinent fixed system information. The onboard computer will contain information that describes the braking characteristics of the type of vehicle on which the equipment is installed. This information can be contained in a data table that is keyed to the vehicle ID number. Thus, the braking characteristics can be automatically selected when the equipment is installed, since the vehicle ID is separate from the electronic unit and inherently associated with the vehicle. The brake characteristic data table then allows the generation of braking profiles specific to a type of vehicle.

If the system uses inductive antennas, the loop ID received by the vehicle from the vehicle location information means and the detection of the loop transposition will provide the vehicle with a means of validating its position in the system. If the system uses beacons, the beacon ID's provide the vehicle with a means of validating its position in the system. The wayside control means will also send to the vehicle the location of any obstacle and the condition of any switches in its path. The vehicle will use this information along with its topographical information, such as civil speed restrictions or station stopping points, to determine its speed/stopping profile. The calculated profile generates the maximum ATP speed limit used for the next system cycle. This profile will then be regenerated upon receipt of the next set of data from the wayside control means or after the vehicle has traveled a predetermined distance. If the data transmission is missed or it contains errors the vehicle will be required to assume the obstacle locations have not moved and act accordingly. If multiple transmissions are missed the vehicle will be required to come to a full service brake stop.

If the vehicle encounters a switch in its path according to its topographical database and the wayside control means has not reported that the switch has locked (i.e., electrically locked which prevents it from being used in a route by another vehicle), then the vehicle will calculate its speed/stopping profile based on that switch as an obstacle. Also, if the vehicle encounters a station stopping point in its database which is closer than the reported obstacle it will calculate its profile to stop at that point. In addition to the station stopping points, the database will also contain the correct door side to be opened for that point. Therefore, once the vehicle has stopped the doors will be opened. The wayside control means can control the dwell time of the vehicle by transmitting an obstacle location equal to the stopping point until the dwell time has elapsed or the wayside control means can transmit to the vehicle a hold with doors open for a predetermined time. Another alternative would be to program the normal dwell time into the system topographical database and then only allow the wayside control means to hold the train longer if required by sending an obstacle location at the stop point.

If a switch is reported normal, or reversed, and locked the vehicle database will provide the correct speed restriction information for that condition. The speed/stopping profile will be generated including the restrictions such that the vehicle enters the switch area below the required speed and then resumes a higher speed (if other conditions allow) only after the end of the vehicle has cleared the restricted area. The use of different loop IDs or beacons on the turn out and straight through track will serve to validate that the train took the expected route both on its topographical database and in reality.

Since the vehicle knows its location on the topographical database, knows the location of all the fixed obstacles (e.g., switch points, stations, etc.) from its database and knows from the wayside control means the location of the nearest temporary obstacle or speed restriction, it can safely control itself.

Non-volatile memory can be used in the vehicle-based means and the wayside control means, this allows topographical data bases to be modified with changed configurations or temporary speed restrictions to be added or removed.

While we have shown and described several embodiments in accordance with our invention, it is to be clearly understood that the same are susceptible to numerous changes apparent to one skilled in the art. Therefore, we do not wish to be limited to the details shown and described but intend to show all changes and modifications which come within the scope of the appended claims.

What is claimed is:

1. A signaling and traffic control system which comprises:

a vehicle-based control means capable of determining the location of a vehicle as it traverses along a guideway, said vehicle-based control means having an onboard computer means with a topographical database and a vehicle database, and means for measuring the speed of said vehicle and the distance which said vehicle has traveled;

wayside control means disposed within each sector of said guideway, said wayside control means capable of communicating with all vehicles within its sector of control and with other wayside control means outside its sector of control;

means for communicating from said vehicle to said wayside control means and from said wayside control means to said vehicle;

a plurality of vehicle location information means disposed along said wayside, so that said vehicle can determine its absolute location along said wayside;

means for communicating from each vehicle location information means to said vehicle, including means on said vehicle for responding to signals received from said vehicle location information means so as to determine said absolute location of said vehicle; and means for controlling the speed/stopping profile of said vehicle of said vehicle in accordance with inputs received form said onboard computer means, said inputs being generated based on information received from said topographical database and said vehicle database, and based on information communicated to said vehicle-based control means from said wayside control means, from said vehicle location information means, and from said means for measuring the speed of said vehicle and the distance which said vehicle has traveled.

2. The system according to claim 1, wherein said means for communicating between said vehicle and said wayside control means is a vehicle-based transmitter/-receiver means and a wayside-based transmitter/-receiver means.

3. The system according to claim 2, wherein said vehicle-based transmitter/receiver means and said wayside-based transmitter/receiver means include transmitters, receivers, couplers, isolators and antennas.

4. The system according to claim 1, wherein said topographical database includes guideway characteristics and fixed obstacle locations and said vehicle database includes vehicle characteristics.

5. The system according to claim 1, wherein said means for measuring the speed of the vehicle and the distance which said vehicle has traveled is at least one tach generator.

6. The system according to claim 1, wherein said vehicle-based control means further comprises:

means for reading inputs by said onboard computer means;

means for receiving communications from said means for measuring the speed of said vehicle and the distance which said vehicle has traveled, and a means for sending those communications to said onboard computer means; and means for setting outputs by said onboard computer means.

7. The system according to claim 1, wherein said vehicle location information means includes an inductive loop.

8. The system according to claim 7, wherein said means for communicating from each vehicle location information means to said vehicle is a transformer winding disposed within said inductive loop and a vehicle-loop antenna.

9. The system according to claim 1, wherein said vehicle location information means is a beacon means.

10. The system according to claim 9, wherein said means for communicating from each vehicle location information means to said vehicle is a vehicle-based beacon antenna and a wayside beacon.

11. The system according to claim 9, wherein said vehicle-based control means further comprises:

a vehicle-based beacon antenna;

means for receiving communications from said vehicle-based beacon antenna;

means for reading said communications received from said vehicle-based beacon antenna; and means for transmitting the communications received from said vehicle-based beacon antenna to said onboard computer means.

12. The system according to claim 1, wherein said onboard computer means is a microprocessor.

13. The system according to claim 1, wherein said vehicle has a last known location and a current location, and said onboard computer means further comprises a means for calculating the distance from the last known location of said vehicle along said guideway, thereby establishing the current location for said vehicle.

14. The system according to claim 13, wherein said onboard computer means further comprises a storage means capable of retaining information as to the last known location of said vehicle along said guideway.

15. The system according to claim 14, wherein said storage means comprises a non-volatile memory.

* * * * *